US009830770B2

(12) United States Patent
Reaves et al.

(10) Patent No.: US 9,830,770 B2
(45) Date of Patent: Nov. 28, 2017

(54) SECURE REMOTE GAMING PLAYER REGISTRATION

(71) Applicant: Mobile Gaming Technologies, Inc., Oakland, CA (US)

(72) Inventors: Michael Reaves, Orinda, CA (US); George Weinberg, Daly City, CA (US)

(73) Assignee: Mobile Gaming Technologies, Inc., Oakland, CA (US)

( * ) Notice: Subject to any disclaimer, the term of this patent is extended or adjusted under 35 U.S.C. 154(b) by 322 days.

(21) Appl. No.: 14/558,573

(22) Filed: Dec. 2, 2014

(65) Prior Publication Data

US 2016/0155293 A1 Jun. 2, 2016

(51) Int. Cl.
*G07F 17/32* (2006.01)

(52) U.S. Cl.
CPC ..... *G07F 17/3241* (2013.01); *G07F 17/3218* (2013.01); *G07F 17/3223* (2013.01); *G07F 17/3234* (2013.01); *G07F 17/3237* (2013.01)

(58) Field of Classification Search
CPC ..... G07F 17/3241; G07F 17/3218
See application file for complete search history.

(56) References Cited

U.S. PATENT DOCUMENTS 6,012,144 A * 1/2000 Pickett ..... G06Q 20/04 380/33
6,088,683 A * 7/2000 Jalili ..... G06Q 20/00 379/93.23
6,748,367 B1 * 6/2004 Lee ..... G06Q 20/06 705/21
6,882,979 B1 * 4/2005 Reay ..... G06Q 30/06 705/26.41
8,645,271 B2 * 2/2014 Remy ..... G06Q 20/04 705/35
2008/0299970 A1 * 12/2008 Roberts ..... G06Q 20/322 455/435.1
2009/0125340 A1 * 5/2009 Gosney ..... G06Q 50/30 705/5
2011/0201408 A1 8/2011 Gagner
2011/0251949 A1 10/2011 Kay
2013/0130781 A1 * 5/2013 Anderson ..... G07F 17/3255 463/25

(Continued)

*Primary Examiner* — Dmitry Suhol
*Assistant Examiner* — David Duffy

(57) ABSTRACT

An electronic wager based gaming system includes primary communication devices, a game administration server component, and a player account server component, all adapted to communicate with separate third party computing (i.e., player) devices, such as smart phones. The game administration component administers wager based game play on player devices and communicates game inputs and results therewith via primary communication devices. The player account component facilitates new player account creation by providing unique verification information to the player device (such as via display to the player) and facilitating the reception of player specific financial information from the player via a separate secondary communication device. This secondary device can involve a voice call with a human operator for the system, where the operator enters the new player information, which is then sent back to the player device via the primary communication device and confirmed by the player over the voice call.

19 Claims, 6 Drawing Sheets

(56) References Cited

U.S. PATENT DOCUMENTS

| | | | | |
|---|---|---|---|---|
| 2014/0162768 | A1* | 6/2014 | Nelson | G07F 17/32 463/25 |
| 2014/0256423 | A1 | 9/2014 | Williams | |
| 2015/0044987 | A1* | 2/2015 | Menon | H04M 15/705 455/406 |
| 2015/0072762 | A1 | 3/2015 | Curtin | |

* cited by examiner

SECURE REMOTE GAMING PLAYER REGISTRATION

TECHNICAL FIELD

The present invention relates generally to electronic wager based gaming systems, and more particularly to player registration for such electronic wager based gaming systems.

BACKGROUND

Wagering games such as blackjack, poker, baccarat, roulette, craps, bingo, keno, slot machines, and sports betting, among many others, are popular games offered in casinos and other similar establishments. These games are typically administered, maintained and monitored by human dealers and other personnel of the casino or other gaming establishment. Alternatively, or in addition, such wagering games can be played on electronic gaming machines or other computing devices, where the dealer, playing cards, chips and/or other gaming elements may be virtual or electronic.

There can be numerous advantages in providing such wagering games virtually via various types of electronic devices, whether online or over a network. Such electronic versions of games can scale rapidly for many multiples of players, which tends to require less overhead for a gaming operator. Also, many players can be more attracted by the anonymity and ease of playing in an online environment. Further, some of these online and other virtual gaming systems can be even more attractive where players are permitted to play remotely and/or on their own personal computing devices, such as their own home computers, laptops, tablet devices, cell phones and the like.

Unfortunately, there are several new drawbacks and disadvantages that arise with respect to online or virtual gaming systems. In addition to issues with legal player verification, fraud, gaming certifications, and other technical issues, there are also issues with signing up new players. Whereas any adult can walk into a brick and mortar gaming establishment and wager cash or otherwise establish gaming credit face to face with gaming operator personnel, such issues can sometimes be trickier when players want to wager monetary values on games electronically, and often remotely. One particular example that can be readily appreciated is the generally cumbersome and often annoying steps and inputs that are required to establish a gaming account at an initial sign up stage. As in the case of many types of online registrations or sign ups, typing in many different inputs regarding user names and information, account profile details, and information regarding credit cards or other accessible monetary value vehicles can turn off many people. Although many players have no qualms about going through such a process, it is readily recognizable that many potential players and other subscribers are lost because of the difficulty or general annoyance just in registering and setting up an online account.

While electronic wagering gaming devices and systems therefor have worked well in practice over many years, there is always a desire for improvement. To that end, it would be desirable to have improved electronic wagering gaming systems that allow for remote gaming and game account management by players, and in particular for such systems to be able to provide a more streamlined and user friendly new player registration and account creation process.

SUMMARY

It is an advantage of the present disclosure to provide improved electronic wager based gaming systems that include a more user friendly and dynamic process to register new players and create player accounts therefor. This can be accomplished at least in part by providing unique verification information via a primary communication device to a new player on a third party device and then receiving player specific financial information from the new player via a separate secondary communication device that is different from the primary communication device and third party device.

In various embodiments of the present disclosure, an electronic gaming system adapted to host games involving wagers, game play based on the wagers, and monetary awards based on the results of the game play can include one or more primary communication devices to facilitate communications with separate third party computing devices, a game administration server component coupled thereto to administer the play of wager based games by players on the third party computing devices, and a player account server component coupled to the primary communication device(s) and/or game administration server component, which can facilitate the communication of inputs and results of the wager based games from and to the players on the third party computing devices via the primary communication device (s). The player account server component can facilitate the creation of new player accounts, such as by providing unique verification information to a new player on a third party computing device via one of the primary communication devices and receiving player specific financial information from the new player via a separate secondary communication device that is different from the primary communication device and different from the third party computing device.

In various detailed embodiments, the third party computing device can be a smart phone adapted for electronic communications with at least one of the primary communication devices, and also for voice call communications with the secondary communication device. The primary communication device(s) can be one or more modems, routers, network interfaces, and/or other electronic communication components for one or more host side computers, servers, and/or other electronic devices. The secondary communication device(s) can include a telephone and/or other device that is separate from and that communicates in a mode or manner that is different from the mode or manner of communication of the primary communication device(s). For example, the secondary communication device can include a telephone that is used for a voice call with a live human or robotic operator affiliated with the electronic gaming system.

In various detailed embodiments, the overall system can be adapted to accept the input of player specific financial information by an operator on a voice call. For example, the system can be adapted to allow the live operator to communicate with the new player via both the primary communication device and the secondary communication device. Creation of a new player account can include sending the player specific financial information input by the operator back to the third party computing device of the player via a primary communication device, as well as displaying on the third party computing device the player specific financial information that was sent. Further, the creation of a new player account can also include a positive confirmation of the player specific financial information displayed on the third party computing device from the player to the operator via the voice call over the telephone.

In various detailed embodiments, the unique verification information can be specific to the third party device that is used by the new player during the new player account creation process. For example, the system can be adapted to assign a unique identifier as its unique verification information to each different third party device that communicates with the system. Also, the system can be adapted to remember the unique identifier assigned for a third party device whenever that third party device later communicates with the system. Such unique verification information provided to the third party device can comprise a unique number or code, and can be displayed on the display screen to the user of the third party device. Such a display can be made in response to a specific input by the third party device user while the third party user device is engaged with a website or application operated by the electronic gaming system. Further, the unique verification information provided to the third party device can be forwarded from the third party device to a separate automated call reception entity that is adapted to verify the unique identity of the third party device. In some embodiments, the player specific financial information can include a deposit having monetary value. In addition, the secondary communication device can be included as part of the overall electronic gaming system in some embodiments.

In further embodiments, various methods of registering a new player remotely for an electronic wager based gaming system are provided. Pertinent process steps can include providing unique verification information to a prospective new player on a third party computing device of the player via a system electronic communication device, prompting a telephonic voice call to be placed between the new player and a live human operator affiliated with the electronic wager based gaming system, wherein the telephonic voice call is received on a communication device that is separate from the system electronic communication device, facilitating verification of the unique verification information from the new player over the telephonic voice call, enabling the reception of player specific financial information from the new player over the telephonic voice call, and accepting the entry of the player specific financial information by the live human operator into the electronic wager based gaming system. Additional process steps can include permitting the third party computing device access to a website or application operated by the electronic wager based gaming system, displaying a registration prompt on the screen of the third party computing device as part of the system website or application, and accepting an input from the player on the registration prompt. The accepting step can result in the prompting step. Also, the registration prompt can include a display to the player of the unique verification information.

In still further embodiments, a computer readable medium can include at least computer program code for facilitating a new player registration according to the foregoing methods. Various other computer codes, functions, and features can also be provided alone or in any combination, such as any of the functions or features set forth above in other embodiments.

Other apparatuses, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed devices, systems, and methods regarding secure remote gaming player registration for electronic wager based gaming systems. These drawings in no way limit any changes in form and detail that may be made to the disclosure by one skilled in the art without departing from the spirit and scope of the disclosure.

DETAILED DESCRIPTION

Figure 1:
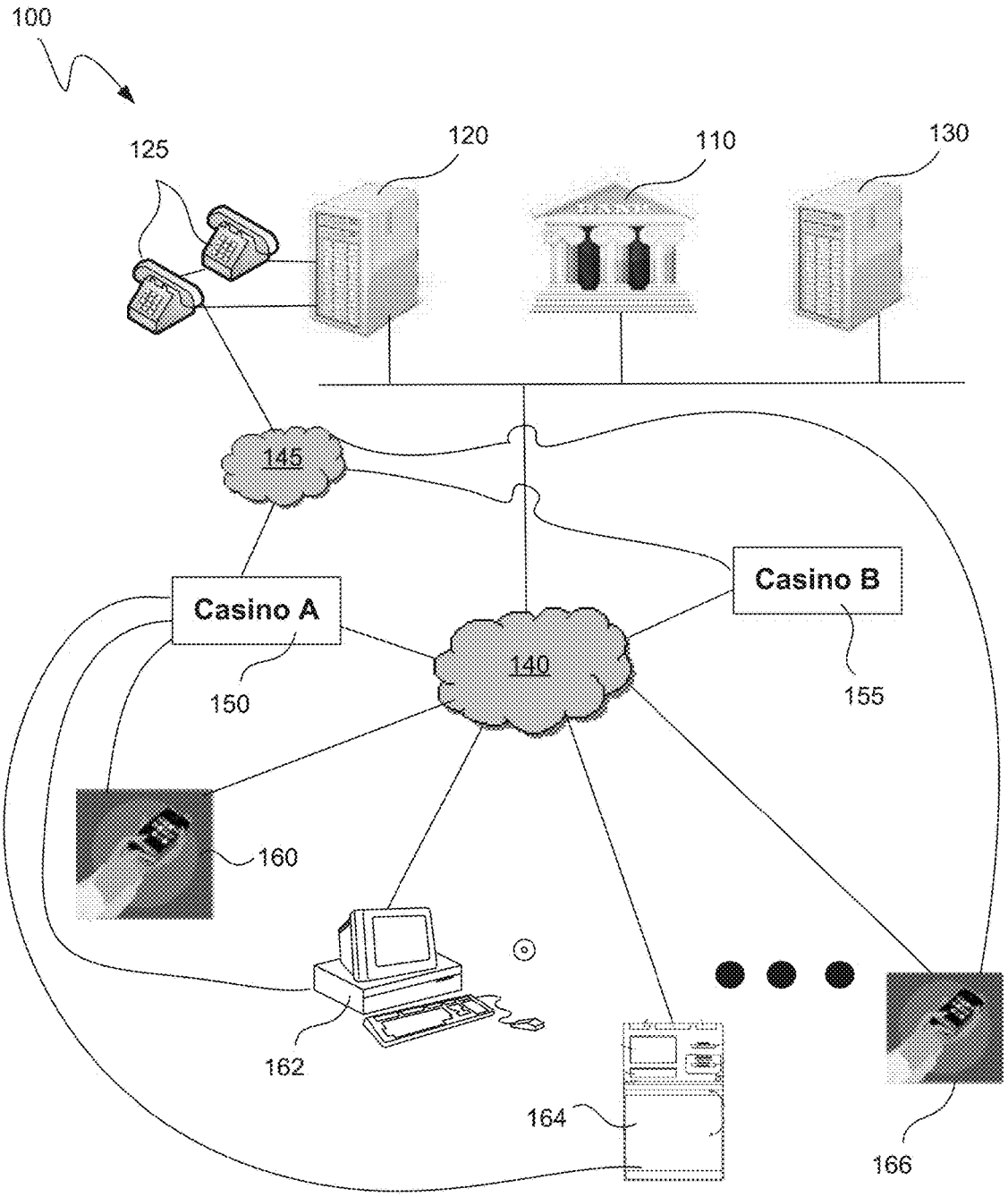
FIG. 1 illustrates in block diagram format an exemplary gaming system and network adapted for the play of wager based games according to one embodiment of the present disclosure.

Exemplary applications of apparatuses and methods according to the present disclosure are described in this section. These examples are being provided solely to add context and aid in the understanding of the disclosure. It will thus be apparent to one skilled in the art that the present disclosure may be practiced without some or all of these specific details. In other instances, well known process steps have not been described in detail in order to avoid unnecessarily obscuring the present disclosure. Other applications are possible, such that the following examples should not be taken as limiting.

In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure relates in various embodiments to devices, systems and methods for registering a new player remotely for an electronic wager based gaming system adapted for the play of wagering games on and/or with the use of electronic devices. As such, this disclosure may be applied to any type of wagering game or event, such as table games, slot machines, sports wagering, and the like. Game types can include, for example, slot machines, sports wagers, baccarat, blackjack, roulette, craps, pai gow, sic bo, poker, bingo, keno, card games, and the like, among many other possibilities. The various embodiments disclosed herein can be applied with respect to virtual games played entirely electronically, as well as live games or events, which can include physical slot machines, gaming tables, keno and bingo boards and items, sporting events, and the like. Although the present disclosure relates to the remote registration of players with respect to wager based gaming systems, it will be readily appreciated that the various embodiments, systems, devices, methods, and features disclosed herein can be similarly applied to other systems that might utilize the remote registration of persons. Such systems can involve many other different alternative purposes or functions, such as, for example, non-wager based gaming, banking or other financial endeavors, credit applications, online purchases, education, voting, and vehicle registration, among many other possibilities. It is to be understood that the present disclosure can be applied to other such systems as well.

The present disclosure contemplates having a graphical user interface ("GUI") or other suitable display on an appropriate electronic or computing device, with such an interface or display operating to facilitate the remote registration and/or account creation of a person or player. Such a GUI or other display presentation can include the provision of a web page, application page, or other display that provides information to the person or player, which may include unique verification information, a registration prompt, and/or other pertinent registration or account creation item(s). The systems and items of the present disclosure can be adapted to operate within a greater network of components, which can include one or more financial institutions, as well as gaming establishment servers, and/or a plurality of player terminal devices. The player terminal devices can be provided on electronic or computing items that are provided by casinos or other gaming establishments, and/or can also take the form of third party computing devices, such as personal computers, smart phones, tablets, laptops, and the like. As such, applications and other software components can be provided to run on the various player terminals wherever they are provided.

In general, the player or gaming terminals may involve any platform capable of receiving and transmitting data, including "thin-client" platforms or platforms which do not process game play data and "smart" platforms or platforms which process game play data. The gaming terminal may be stationary, similar to the slot machines or electronic tables commonly seen at the physical casino, or portable electronic devices such as smart phones, computer tablets, portable media players, laptop computers, desktop computers, smart TV, smart glasses, and the like. Additionally, the respective gaming network can be of wired (Ethernet, Token Ring, Serial multidrop, etc.) or wireless variety (802.11x, BlueTooth, LTE, 2G/3G/4G cellular, Zigbee, Ultra Wide Band, etc.) known in the art. Such a network can be a close proprietary LAN or WAN, or can be over the Internet generally. Thus, players interested in participating in wager based gaming are not confined to a physical gaming table, slot machine, or anywhere on an actual casino floor.

Referring first to FIG. 1, an exemplary gaming system network adapted for the play of wager based games is presented in block diagram format. Wide area system or network 100 can include a variety of components and items, such as a bank 110, one or more gaming servers 120, one or more secondary communication devices 125, and a financial clearinghouse 130. A first cloud 140 or network can couple one or more of these items to various casinos 150, 155, individual player terminals 160-166, and other distributed components. It will be understood that at least one communication mode through first cloud 140 can be through TCP/IP, HTTP, and/or other suitable Internet or similar networked connections. One or more personal devices such as smart phones 160, 166 and/or personal computers 162 can serve as on site or remote player terminals in some embodiments. Various casino or other gaming establishment provided player terminals or kiosks 164 may also be provided.

In addition, at least the one or more secondary communication devices 125 can couple to one or more of the various casinos 150, 155, player terminals 160-166, and/or other distributed components via second cloud 145. Such communications can be through at least one communication mode that is separate and/or independent from one of the communication modes of first cloud 140, such as, for example, PBX, regular wired phone lines and/or a cellular phone network. Secondary communication devices 125 may or may not be in communication with one or more gaming servers 120, and such devices 125 may or may not be coupled to first cloud 140 and its communication mode(s). In some embodiments, a human operator, robotic operator or other component can be used to communicate information further from one or more secondary communication devices 125 to the gaming server(s) 120.

In various embodiments, bank 110 can be contacted to verify and authenticate the deposit of actual funds into player accounts, which can be facilitated by the one or more gaming servers 120. Such gaming servers can include multiple server components, as set forth below. One or more communication devices can couple the server(s) for communications over cloud 140, which can be the Internet or any other suitable network. The financial clearinghouse ("FCH") 130 can be a centralized entity that keeps track of gaming wagers across multiple remote terminals. The FCH received information regarding player account balances, wagers, game results, and the like, and settles all accounts by crediting or debiting them as may be appropriate.

In various embodiments, one or more remote servers 120 can be adapted to administer some or all of the gaming functions away from the actual player terminal(s). The remote server(s) can include a game administration server component, a player account server component, and/or one or more other server components, as may be desired. The player account server component can include or be associated with a new player registration server component or function. These server components can reside on the same remote server, or can be distributed across multiple servers and/or locations, as will be readily appreciated. The game administration server or server component can have the rules of the game, and can be responsible to conduct the wager based game regardless of where the game is actually played, whether physical items are used, and whether a player is actually physically present where the game is played. This server can provide any number of functions, such as, for example, to process the game according to game rules, store the game states, keep track of game history, resolve player hands, credit or debit local player running accounts or scores, run a community display, and the like.

The player account server component can be adapted to manage the monetary fund input and output for wager based gaming accounts. As such, the player account server can operate to facilitate the deposit and withdrawal of funds into player accounts, such as might involve the use of credit cards, debit cards, e-checks, financial institutions, and the like. Other player account functions, such as establishing, modifying, monitoring, or closing player accounts, may also be handled by the player account server component. Some player account functions can be handled by a new player registration server component, for example, further details for which are provided below. A new player registration function can also be performed within the player account server component.

As will be readily appreciated, programs set to run on the remote or other backend servers and server components, as well as programs set to run on the various different player terminals, can all involve the use of software or code that is specially programmed to accomplish the various features and results set forth herein. Some of the various functions can include the provision of unique verification information, a new player registration prompt, and other information to assist in the registration of a new player. Again, such a player terminal can be a number of different things at a number of different locations, and can include any electronic or computing device that is suitable to operate for the player as a gaming terminal.

During a typical process involving a remote registration of a new player, the prospective new player must enter a slew of personal information on the respective remote electronic device. This can involve the manual entry of numerous items, often on a small touchscreen or keypad such as that which might be found on a smart phone or other small personal electronic device. This can be relatively time consuming, inconvenient, and cumbersome, with mistakes or typos then involving extra steps or inconvenience to the player to undo progress or even restart the process. This can cause many prospective players to abort a new registration process, frequently out of frustration or because of the tedious nature of entering lots of personal data.

This particular process can be streamlined and made much more user friendly, however, by instead providing assistance to the prospective player in the form of a human or robotic operator on a voice call, among other possibilities. Upon indicating that he or she would care to begin a new player registration process, a voice call can then be arranged between the prospective player and an operator, which can be human or robotic. The new player can then be asked for specific informational items, which can then be provided simply by the voice of the player over the voice call, whereupon the provided data can be entered into the system by the operator or an associated entity. Verification of the entered data can also take place, such as by providing the new player with display feedback on his or her display screen of the third party device. Such a process is much more convenient and user friendly for the prospective player, such that more new players will follow through to the end of the registration process.

In various embodiments, particular care is taken to ensure a greater level of security with respect to the creation of new player accounts done in this manner. For example, a unique identifier or verification information can be provided to the remote player device, and such an identifier or information can be recorded for tracking and determination purposes. In addition, the use of two separate modes of communication can be employed such that it is more difficult to defraud or trick the system during the registration of a prospective new player. Further, the system can be designed such that a new player registration process is not entered into unless a player or user has positively elected for such a process to take place.

Figure 2:
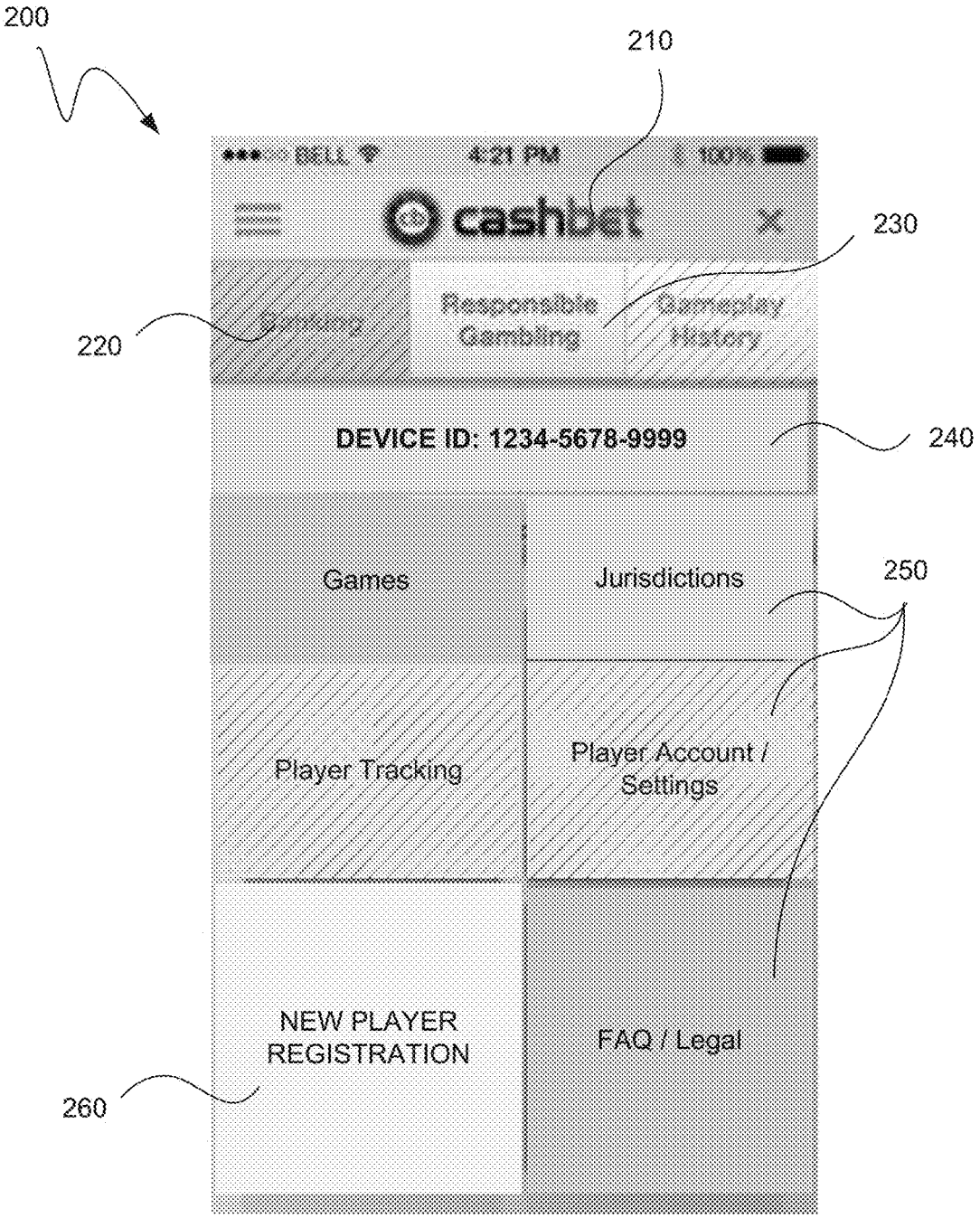
FIG. 2 illustrates an exemplary screenshot of a display page having unique verification information on a third party computing device according to one embodiment of the present disclosure.

Turning next to FIG. 2, an exemplary screenshot of a display page having unique verification information on a third party computing device is shown. Again, such a third party computing device can be a smart phone or other personal portable device that is owned by a player or prospective player, and which can be remotely located from any of the other gaming system components, and or any actual gaming location(s). Screenshot 200 is one example of a GUI that can be presented to a player under the current system. As shown, screenshot 200 can take place on a display of a third party computing device, and can depict a presentation on a web page or proprietary application as accessed by the player or prospective player. In this case, the user can either access a web page on a browser of the third party device, or has downloaded and activated a proprietary app that might be available on an app store associated with the third party device.

Once inside the appropriate web page and/or app or application location, a unique identifier or other similar information can be assigned to the third party device. Such a unique identifier can be for example, a MAC address, device serial number, or other informational item that is associated with the unique device that has accessed the web page or app. Alternatively, such a unique identifier can be generated and assigned by the system upon being accessed by the unique third party device. Such an alternatively generated and assigned unique identifier can then be stored in a database associated with the system, along with a MAC address, device serial number, or other readily detectable data item associated with the device. As such, the unique identifier can then be retrieved and used upon future visits to the web page and/or app by that device, as may be desired.

As shown, an application or "app" identifier, or other logo 210 can be present at the top or other prominent location in screenshot 200. Such an identifier 210 can reflect that this particular gaming application or program is provided by CashBet of Oakland, Calif., for example. As part of the provided web page, application, or app, a first set of program buttons 220, 230 can provide selections to Banking, Responsible Gaming, and Gameplay History, among other possible selections. In the event that the user is not logged in to a recognized player account on the web page, app, or system, then some of the buttons or selections may not be available. For example, shaded buttons 220 might not be available unless the user is logged in with a valid account, while unshaded buttons 230 might be made available to any user regardless of login status. Similar button shadings might be applicable for other buttons, such as buttons 250 below.

An identifier region 240 might contain a unique code, identifier, or other specific information that is unique for the particular device displaying screenshot 200. In this particular example, a 12-digit device ID number is shown, although it will be readily appreciated that a specific MAC address, device serial number, or other unique identifier might be alternatively or similarly used in such an identifier region 240. Again, the unique verification information displayed can be assigned upon the first instance of the device accessing the pertinent web site and/or app, with this information then remaining constant for all future visits of the device. This identifier region 240 with its unique verification information may or may not persist through multiple page views or screenshots on the respective web site and/or application or app, as may be desired.

Additional button choices 250, 260 beneath region 240 can also be made available to the user, with such choices including the various games, jurisdictions, player tracking and account settings, FAQs, legal information, and/or any other pertinent choices that can be made available to players and/or prospective players or users. Among these choices can be a button for new player registration 260. Such a new player registration process may be entered into, for example, as a result of a user pressing or otherwise activating this button 260. This can be particularly true where the device is not logged in to any active player account. Of course, other ways of activating a new player registration process are also possible, such as, for example, where a user attempts to access a shaded button choice like "Banking" or "Player Tracking" while not logged in. In the event that a user selects button 260, then a registration prompt or other trigger may be activated.

Figure 3A:
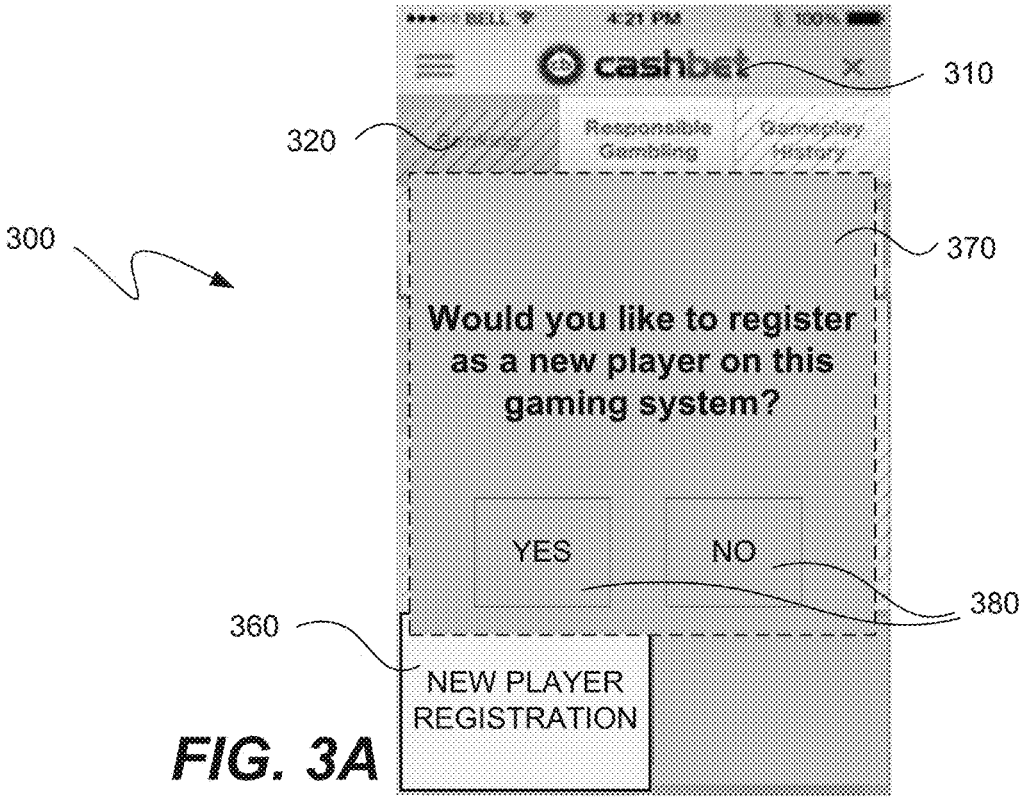
FIG. 3A illustrates an exemplary screenshot of a display page having a registration prompt on a third party computing device according to one embodiment of the present disclosure.

Continuing with FIG. 3A, an exemplary screenshot of a display page having a registration prompt on a third party computing device according to one embodiment of the present disclosure is provided. Screenshot 300 is another example of a GUI that can be presented to a player under the current system. In this case, screenshot 300 can be that which is provided to a player on a smart phone or other similar device when a new player registration button choice 360 has been selected. Screenshot 300 can be similar to screenshot 200, in that it can have an identifier or logo 310 present at the top or other prominent location, as well as some program buttons 320 that provide selections to Banking, Responsible Gaming, and Gameplay History, for example.

Because button 360 has been selected, however, much of the rest of similar screenshot 200 can be overlaid with a popup window or other suitable prompt 370. Prompt 370 can ask the user whether he or she would like to register as a new player on the system or otherwise create a new player account. One or more response buttons 380 or choices may be contained within the player prompt 370, such that the player can exit the new player registration process, or can continue if a new player registration is desired. In some embodiments, such as that shown in the popup screen layover in screenshot 300, the prompt, GUI, or screenshot might not contain the unique verification information pertinent to the process. In other embodiments, however, such information might also be shown.

Figure 3B:
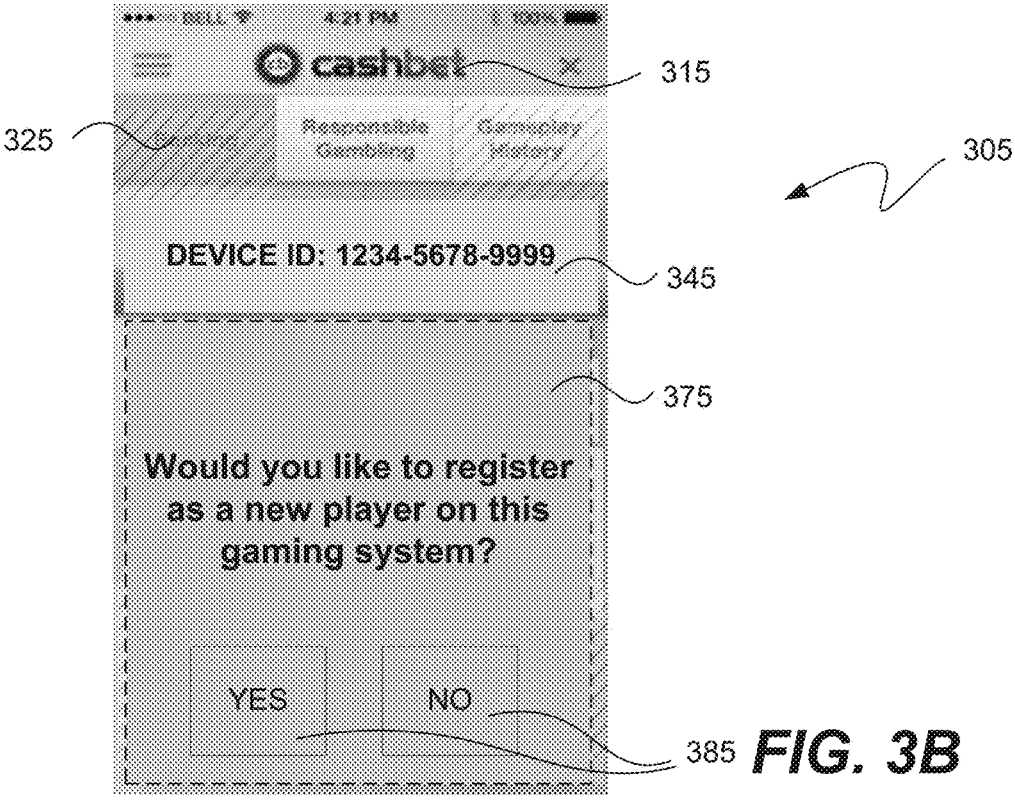
FIG. 3B illustrates an exemplary screenshot of a display page having both unique verification information and a registration prompt on a third party computing device according to one embodiment of the present disclosure.

FIG. 3B, for example, illustrates a screenshot of an alternative display page having both unique verification information and a registration prompt on a third party computing device. Similar to the foregoing embodiments, screenshot 305 can include a logo or other identifier 315, one or more button selections 325, and a new player registration prompt 375 having player input choices 385. In addition, a suitable identifier region 345 can also be visible to the player while the prompt 375 is being displayed. Again, the identifier region 345 can include unique verification information that can be used as part of the new player registration process.

In the event that the user or prospective player does select "yes" or otherwise provide affirmative input that a new player registration is desired, then a voice call can be arranged between the user and a system operator. Again, such a system operator can be a human, an artificial intelligence robot, or some other entity suitable for accepting and verifying information over a voice call. As such, the player can be prompted to call a number to register, which number can be displayed on a respect GUI on the player device. Such a display can be provided after the player selects "yes" or otherwise confirms that a new player registration is desired. Alternatively, the system can be adapted to call the user on his or her device in order to arrange the voice call for new player registration.

Once the voice call is connected between the user and the system operator, then the user can be queried by the human or robotic system operator about the unique verification information displayed on the third party device. Confirmation of such information can provide added security to the new player registration process, since such information can be provided by the first mode of communication (e.g., Internet, TCP/IP, HTTP, etc.), while the confirmation of that information can then take place over a second separate mode of communication (e.g., PBX, cellular phone, etc.). As such, it can be useful for the GUI available to the player during the registration process to provide the unique verification information to the player on a visible display, such as that which is shown in screenshot 305.

Once confirmation is made, then the player can be queried by voice about pertinent information needed to register the player, such that a new player account can be created. Such information can include the user name, age, address, location, ownership of the pertinent third party device, and financial information, for example, among other possible items. The human or robotic operator can ask such questions of the user and then facilitate data entry into the system in accordance with the voice responses provided by the user. In the event that a robotic operator asks the questions, then automated voice recognition and data entry components may also be used. As such, the data collected from the player can be by voice over the second mode of communication. The data that is then entered regarding the new player account can then be sent back to the user or player device over the first mode of communication and displayed on the GUI for the user or player to review. Again, the use of two separate modes of communication can provide added security against attempts to create fraudulent or fake player accounts on the system.

The player can then review the data on his or her screen and confirm to the system operator that the information is accurate. Corrections can be made if necessary by way of back and forth voice communications with the system operator, and the player can then confirm when all data is correct and authorize the final new player registration and account creation for himself or herself. In the end, such a process is much easier and more secure for a new prospective player, since no manual data entry is required, multiple modes of communication are used, and a system operator is available to assist with the registration process. Such a system operator can also be able to answer any questions, or help the new player as may be needed in other regards, as may be desired.

Figure 4:
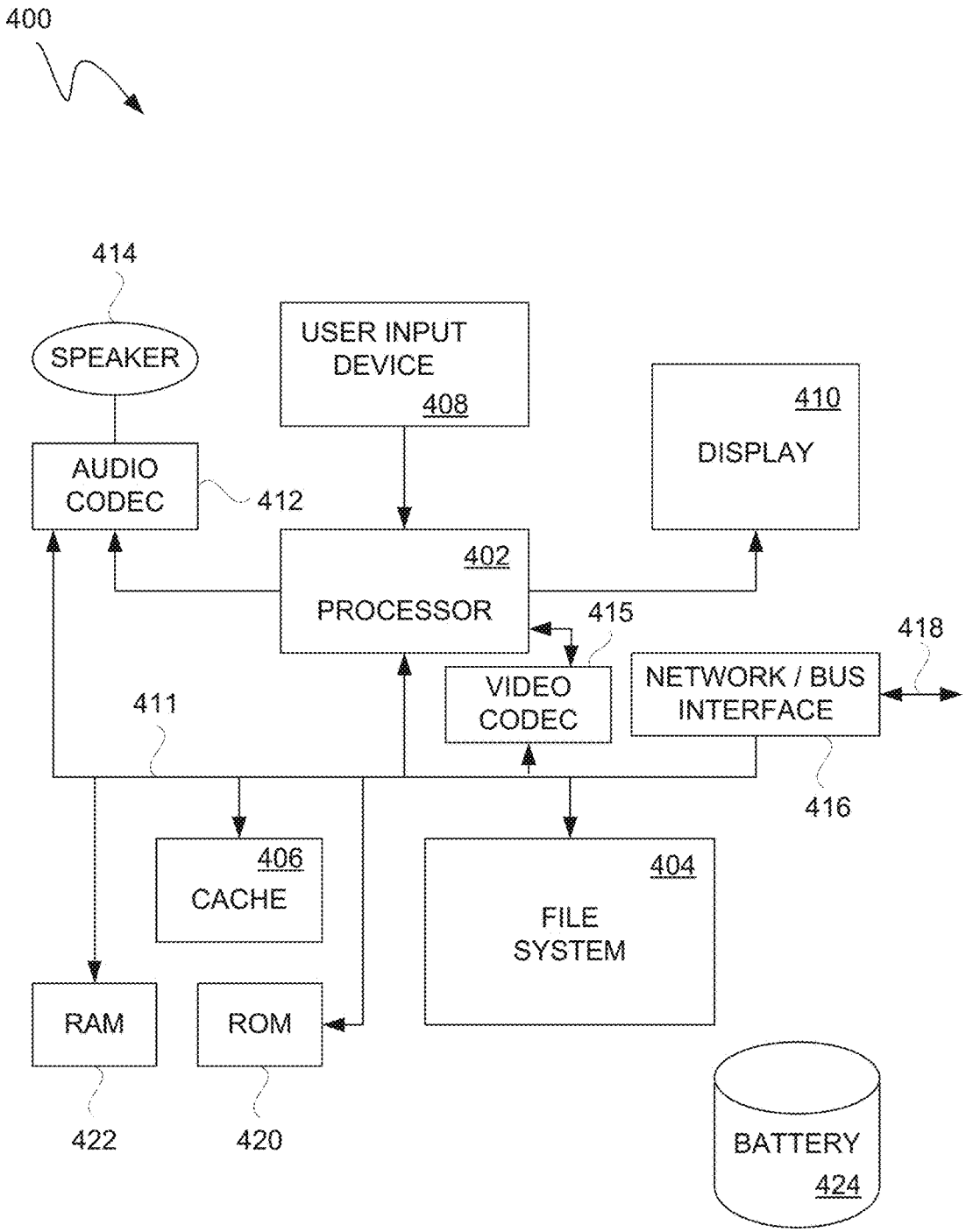
FIG. 4 illustrates in block diagram format the layout of an exemplary portable electronic device suitable for use as a player terminal according to one embodiment of the present disclosure.

While the exemplary GUI and screenshots shown here have been with respect to a smart phone, it will be readily appreciated that such a GUI or similar presentation can be made on any computing or electronic device that can be used as a player terminal. Such player terminals can be owned and operated by the casino or gaming establishment, and/or can be owned and used by the players themselves or another third party. Again various embodiments can include a player terminal that can be a portable electronic device. FIG. 4 illustrates a block diagram of a portable electronic device 400 suitable for such use as a player terminal. Portable electronic device 400 can be, for example, a smart phone, portable media player, personal digital assistant, tablet computer, laptop computer, or any other electronic device suitable for running gaming applications that can include a remote new player registration function. Although device 400 depicts circuitry of a representative portable electronic device, it will be readily understood that some elements may be omitted and others may be added in other electronic devices that may be suitable to function as a player terminal.

Portable electronic device 400 can include a processor 402 that pertains to a microprocessor or controller for controlling the overall operation of the device. Device 400 can store data pertaining to various applications, programs, gaming items, functions, and transaction histories in a file system 404 and a cache 406. The file system 404 can include semiconductor memory (e.g., Flash memory) and/or one or more storage disks. File system 404 can provides high capacity storage capability for the device 400, while cache 406 can provide low capacity but high speed storage capability, as will be readily appreciated. The cache 406 is, for example, Random-Access Memory (RAM) provided by semiconductor memory. Device 400 can be powered by a battery 424, which may be rechargeable. Device 400 can also include a RAM 420 and a Read-Only Memory (ROM) 422. The ROM 422 can store programs, utilities or processes to be executed in a non-volatile manner. The RAM 420 provides volatile data storage, such as for the cache 406.

Device 400 can also include one or more user input devices 408 that allows a user of the device to interact with the device. For example, the user input device(s) 408 can take a variety of forms, such as a button, keypad, dial, touch-sensitive surface, and the like. Still further, the electronic device 400 can include a screen display 410 that can be controlled by the processor 402 to display information to the user. A data bus 411 can facilitate data transfer between at least the file system 404, the cache 406, the processor 402, an audio coder/decoder (CODEC) 412 and/or a video CODEC 415, among other components. Electronic device 400 can also include a network/bus interface 416 that couples to a data link 418 or other communication device or interface. The data link 418 allows the device 400 to couple to or otherwise communicate with another device or over a network. The data link 418 can be provided over a wired connection or a wireless connection. In the case of a wireless connection, the network/bus interface 416 can include a wireless transceiver. In some embodiments, the data link 418 can also provide power to the media player 400 (e.g., to charge the battery 424).

A portable electronic device as discussed herein may, but need not, be a hand-held electronic device. The term hand-held generally means that the electronic device has a form factor that is small enough to be comfortably held in one hand. A hand-held electronic device may be directed at one-handed operation or two-handed operation. In one-handed operation, a single hand is used to both support the device as well as to perform operations with the user interface during use. In two-handed operation, one hand is used to support the device while the other hand performs operations with a user interface during use or alternatively both hands support the device as well as perform operations during use. In some cases, the hand-held electronic device is sized for placement into a pocket of the user. By being pocket-sized, the user does not have to directly carry the device and therefore the device can be taken almost anywhere the user travels. Even smaller, and thus more portable devices, are wearable electronic devices.

Figure 5:
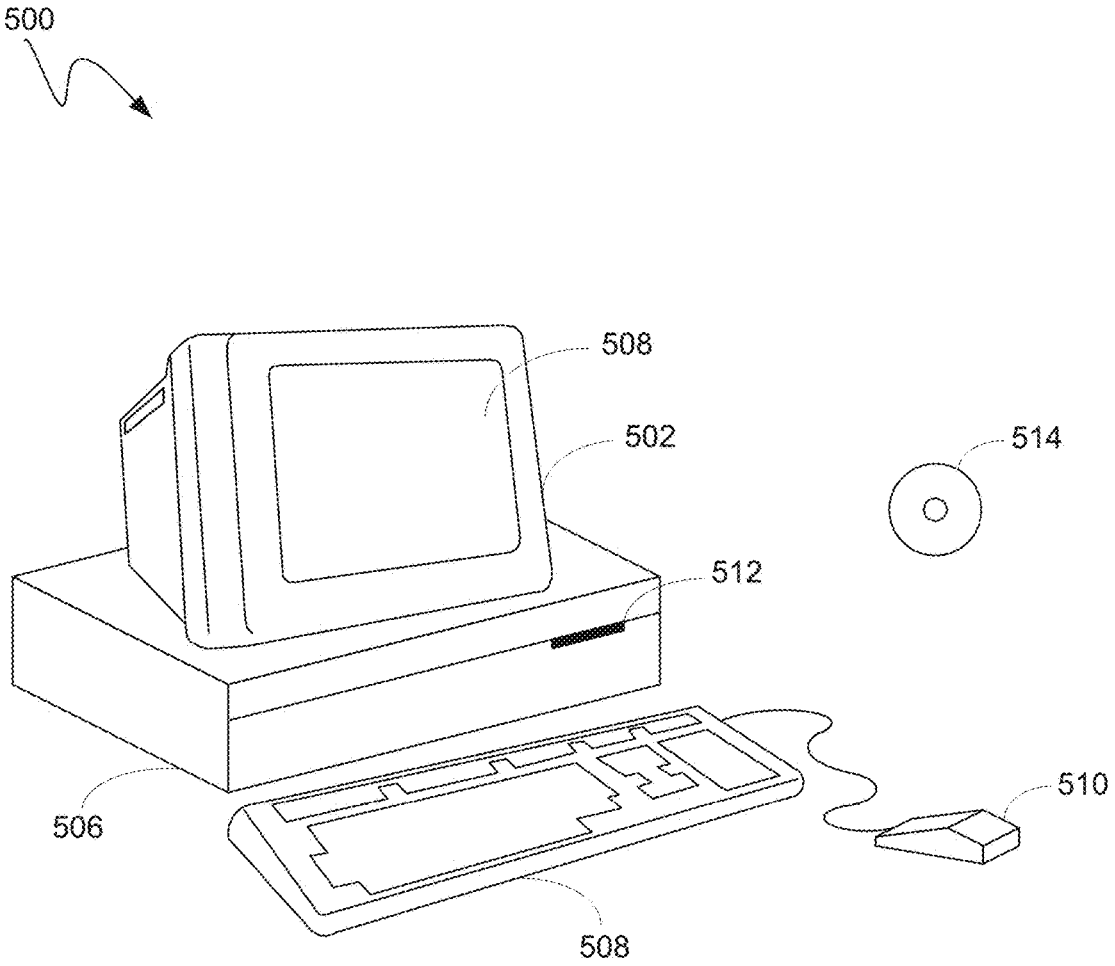
FIG. 5 illustrates in block diagram format an alternative exemplary computer system suitable for use as a player terminal according to one embodiment of the present disclosure.

Moving next to FIG. 5, another exemplary computer system suitable for use as a player terminal is illustrated in front perspective view. Computer system 500 can be, for example, a home or office computer system adapted to communicate over the Internet or other network. Such communication can facilitate the play of wager based games and the deposit of monetary funds into player accounts by using computer system 500. Computer 500 can include, for example, a display monitor 502 having a single or multi-screen display 504 (or multiple displays), a cabinet 506, a keyboard 508, and a mouse 510. The cabinet 506 houses a drive 512, such as for receiving a CD-ROM 514, a system memory and a mass storage device (e.g., hard drive or solid-state drive) (not shown) which may be utilized to store retrievable software programs incorporating computer code that implements the embodiment of the invention, data for use with embodiment(s) of the invention, and the like. Although the CD-ROM 514 is shown as an exemplary computer readable medium, other computer readable digital video including floppy disk, tape, flash memory, system memory, and hard drive may be utilized. It will be readily appreciated that the various GUIs, screenshots, and accompanying features can also be applied to such a computer system 500, such as where this computer system is also located remotely from the various system servers, other system components, gaming locations, and the like. As in the case of portable or hand-held devices, computer system can also be owned by a third party user, such as a player or prospective player.

Figure 6:
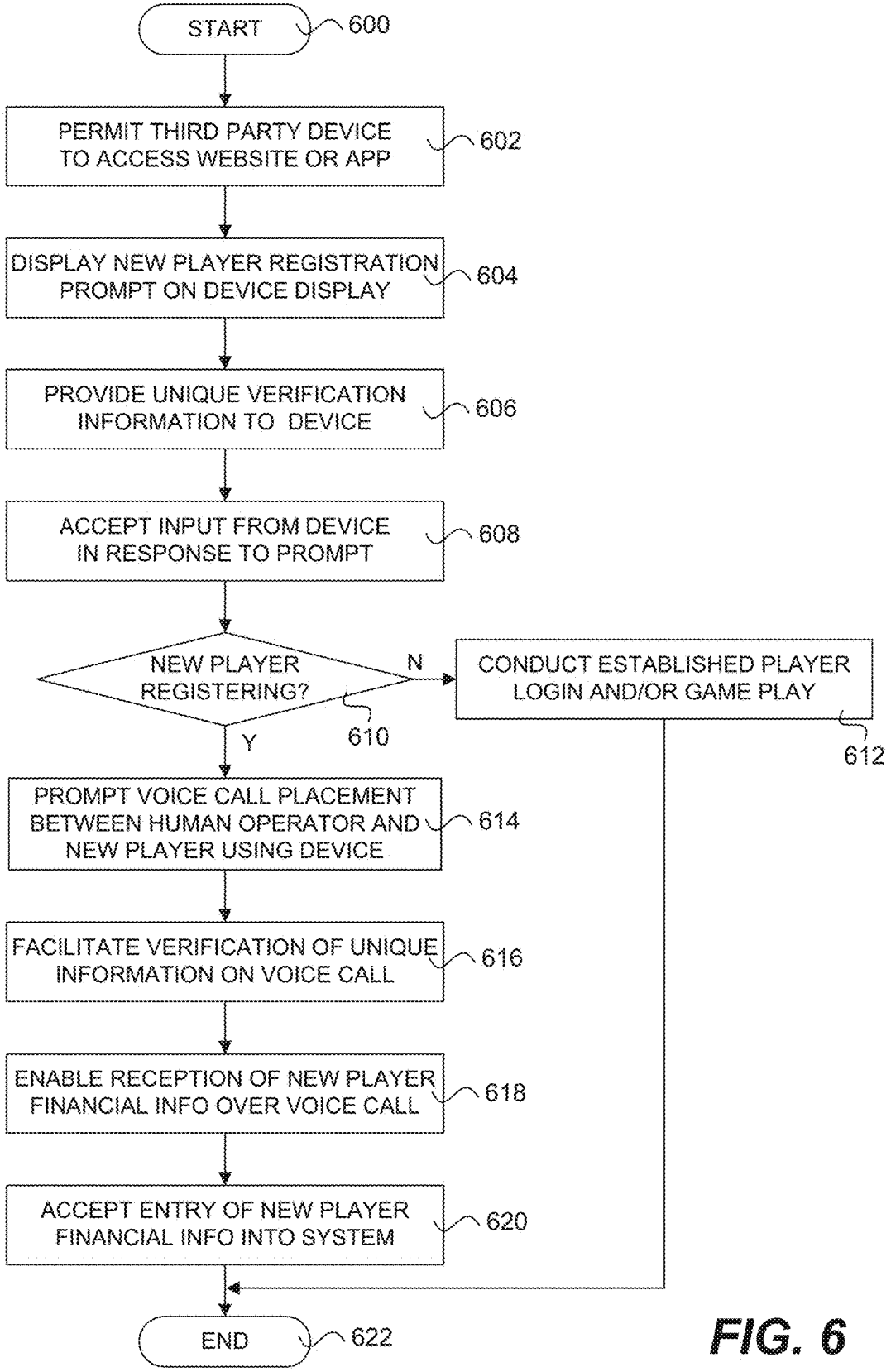
FIG. 6 illustrates a flowchart of an exemplary method of registering a new player remotely for an electronic wager based gaming system according to one embodiment of the present disclosure.

Moving lastly to FIG. 6, a flowchart of an exemplary method of registering a new player remotely for an electronic wager based gaming system is provided. It will be readily appreciated that other similar methods are also possible, in that not every depicted step is necessary, that the order of steps may be changed in some instances, and that other steps not shown may also be added. After an initial start step 600, a computer or other electronic device is permitted to access a website or application operated by an electronic wager based gaming system at a process step 602. Access can be allowed over the Internet to a host web page, or can be via a proprietary application or program, such as that which may be provided and downloaded from an "app store" or other program provider for smart phones, tablets, and the like. As noted above, such a computer or other electronic device can be a third party device, such as a smart phone, tablet, laptop, or other device that is owned by a player, prospective player, or other third party.

At a subsequent process step 604, a new player registration prompt can be displayed on a display of the third party device or other electronic device. Such a new player registration prompt can be an automated feature that is provided whenever a device user accesses certain regions of the website or app, but is detected as not being logged in as a registered user, for example. At process step 606, unique verification information can be provided to the device. Again, this can involve the use of a unique code or other assigned device identifier, which can be accomplished in any manner such as those which are set forth above. In addition, step 606 can be performed before or in conjunction with step 604. For example, the unique code or identifier can be displayed to the device user as part of the new player registration prompt, for example. Other pertinent details regarding providing unique verification information can also be applicable, as set forth in greater detail above.

At a following process step 608, an input in response to the new player registration prompt can be accepted from the device. Such an input can be, for example, an input on the device by the device user that reflects a desire to proceed with a new player registration. Such an input can be a simple click of a button or other "yes" acceptance by the user on the device with respect to the prompt. Alternatively, such an input can be a "no" or other button click or input that reflects an input from the user not to proceed with a new player registration, and/or alternatively another course of action on the device. Such another course of action can be, for example, continuing to an existing player log in or some other relevant function with respect to the gaming site or app on the player device. Acceptance of the input can be accomplished on a server or host side system, such as where the input on the device is communicated to the server or system, which may be located remotely from the device.

The method then continues to decision step 610, where an inquiry can be made with respect to whether or not the accepted user input reflects that a new player registration process has been elected. If not, then the process continues to process step 612, where an established player log in, game play action, and/or other relevant activity in response to a "no" input can take place, after which the process can then end at end step 622. If the accepted input is a "yes," however, then the method continues to process step 614, where a voice call can be prompted between a human operator and the new player using the device. Such a prompt can be made to a system side operator to call the new player on his or her device. Alternatively, the prompt can be made to the new player to place a voice call to a number on the system side, such as where a human operator can be reached. In either arrangement, the call number can be displayed to the person who will make the call.

As noted above, a voice call between a human operator on the system side and a new registering player can serve multiple purposes. In addition to making the new player registration process more user friendly and streamlined for the new registering player, such that the new player is less likely to give up or abandon the registration midstream, such a call can also provide more security and safeguards against fraud or crime in that multiple modes of communication are used to register a new player. Furthermore, some level of human interaction is required on both sides of the call, which can discourage some bad actors who are more likely to act improperly only in fully automated situations with no other human involved on the other side.

Accordingly, facilitating the verification of unique information regarding the new registering player on the voice call can be particularly useful, which can be accomplished at process step 616. Such unique information can be identifying and/or financial information regarding the new player, as set forth above. Rather than requiring the new registering player to enter lots of information on his or her smart phone or other similar device, which can be cumbersome and annoying, the new player can be asked a series of questions by the human operator over the voice call. The method then continues to process step 618, where the reception into the system of new player financial information obtained by the voice call is enabled. This can be accomplished, for example, by the human operator typing in or otherwise entering such information into the system, which can be done while on the call with the new registering player or shortly thereafter.

Acceptance of the new player financial information into the system is then accomplished at process step 620. The new player account can then be saved on one or more system databases or locations, and the new player is then registered into the system. The method then ends at end step 622, For the foregoing flowchart, it will be readily appreciated that not every method step provided is always necessary, and that further steps not set forth herein may also be included. For example, added steps to involve additional player input or preferences may be added. Also, steps that provide more detail with respect to the player financial information can also be included. Furthermore, the exact order of steps may be altered as desired, and some steps may be performed simultaneously. For example, steps 616 and 618 can be performed simultaneously, and possibly in addition to step 620 as well. In addition, while the provided examples are with respect to new player registration in a gaming system, it will be readily understood that other similar new player or member registrations outside of a gaming context may also be applicable.

It should be understood that the devices, systems and methods described herein may be adapted and configured to function independently or may also interact with other systems, apps, or applications, such as for example, a casino management system, player tracking system, hospitality system, player loyalty or rewards system, banking application, or the like. As such, there can be various links, menus or callouts on the graphical user interface or other display that can allow the player to access other gaming, casino, loyalty, hospitality, restaurant, banking, and/or other functions while on the proprietary website or app of the system operator. It should also be readily apparent that additional computerized or manual systems may also be employed in accordance with the disclosure in order to achieve its full implementation as a system, apparatus or method.

Those skilled in the art will readily appreciate that any of the systems and methods of the disclosure may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as an existing electronic gaming machine, portable computing device or various electronic platforms. In addition, the system of the disclosure may be provided at least in part on a personal computing device, such as home computer, laptop or mobile computing device, such as a smart phone, through an online communication connection or connection with the Internet. Those skilled in the art will further appreciate that the exact types of software and hardware used are not vital to the full implementation of the methods of the disclosure so long as players and operators thereof are provided with useful access thereto for the purposes provided herein.

The various aspects, embodiments, implementations or features of the described embodiments can be used separately or in any combination. Various aspects of the described embodiments can be implemented by software, hardware or a combination of hardware and software. Computer readable medium can be any data storage device that can store data which can thereafter be read by a computer system. Examples of computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. An electronic gaming system adapted to host games involving wagers, game play based on the wagers, and monetary awards based on results of the game play, the electronic gaming system comprising:

one or more primary communication devices adapted to facilitate communications with player computing devices that are distinct from said electronic gaming system;

a game administration server device coupled to said one or more primary communication devices, wherein said game administration server device is adapted to administer play of wager based games by players on the player computing devices and to communicate inputs and results of the wager based games from and to the players via said one or more primary communication devices; and a player account server device coupled to said one or more primary communication devices and said game administration server device, wherein said player account server device is adapted to facilitate creation of new player accounts by new players on the player computing devices, wherein creation of a new player account includes providing unique verification information to a new player on a first player computing device of the player computing devices via a first of said one or more primary communication devices, and wherein the creation of the new player account further includes reception of player specific financial information from the new player via a secondary communication device that is different from said one or more primary communication devices and different from the first player computing device, wherein the player computing devices have capabilities for electronic communications with at least one of the one or more primary communication devices and for voice call communications with the secondary communication device, and wherein the electronic gaming system is adapted to allow the live operator to communicate with the new player via both the first of said one or more primary communication device and the secondary communication device.

2. The electronic gaming system of claim 1, wherein the first player computing device is a mobile computing device.

3. The electronic gaming system of claim 1, wherein the secondary communication device includes a telephone that is used for a voice call with a live operator affiliated with the electronic gaming system.

4. The electronic gaming system of claim 3, wherein the electronic gaming system is adapted to accept input of the player specific financial information.

5. The electronic gaming system of claim 4, wherein the creation of a new player account further includes sending the player specific financial information that has been input back to the first player computing device via the first of said one or more primary communication devices.

6. The electronic gaming system of claim 5, wherein the creation of a new player account further includes displaying on the first player computing device the player specific financial information sent back to the first player computing device via one or more of said primary communication devices.

7. The electronic gaming system of claim 6, wherein the creation of a new player account further includes a positive confirmation of the player specific financial information displayed on the first player computing device to the live operator via the voice call over the telephone.

8. The electronic gaming system of claim 1, wherein the unique verification information is specific to the first player computing device that is used by the new player during creation of the new player account.

9. The electronic gaming system of claim 8, wherein the electronic gaming system is adapted to assign a unique identifier as its unique verification information to each different one of the player computing devices that communicates with the electronic gaming system.

10. The electronic gaming system of claim 9, wherein the electronic gaming system is adapted to remember the unique identifier assigned whenever that one of the player computing devices later communicates with the electronic gaming system.

11. The electronic gaming system of claim 1, wherein the unique verification information provided to the first player computing device comprises a unique number or code.

12. The electronic gaming system of claim 1, wherein the unique verification information provided to the first player computing device is displayed on a display screen of the first player computing device.

13. The electronic gaming system of claim 1, wherein the unique verification information provided to the first player computing device and is displayed on a display screen thereof in response to a specific input by the first player computing device while the first player computing device is engaged with a website or application operated by the electronic gaming system.

14. The electronic gaming system of claim 1, wherein the unique verification information provided to the first player computing device is forwarded to a separate automated call reception entity that is adapted to verify identity of the first player computing device.

15. The electronic gaming system of claim 1, wherein the unique verification information provided to the first player computing device is adapted to be forwarded to a verification system that is adapted to verify identity of the first player computing device.

16. The electronic gaming system of claim 1, wherein the player specific financial information includes a deposit having monetary value.

17. A non-transitory computer readable medium including at least computer program code executable by a computing apparatus to perform a method for registering a new player remotely for an electronic wager based gaming system, the method comprising:

providing unique verification information to the new player on a player computing device via a system electronic communication device;

prompting a telephonic voice call to be placed between the new player and a live operator affiliated with the electronic wager based gaming system, wherein the telephonic voice call is received on a communication device that is distinct from the system electronic communication device;

facilitating verification of the unique verification information from the new player over the telephonic voice call, the facilitating verification including at least (i) receiving the unique verification information from the new player over the telephone voice call, and (ii) confirming that the received unique verification information from the new player over the telephone voice call matches the unique verification information previously provided to the new player on the player computing device;

enabling reception of player specific financial information from the new player over the telephonic voice call; and accepting entry of the player specific financial information into the electronic wager based gaming system, wherein the player computing device has capabilities for electronic communications and for voice call communications, and wherein the electronic gaming system is adapted to communicate with the new player via the player computing device and the communication device.

18. The non-transitory computer readable medium of claim 17, the method further comprising:

permitting the player computing device access to a website or application operated by the electronic wager based gaming system;

displaying a registration prompt on a screen of the player computing device as part of the website or application; and accepting an input from the new player on the registration prompt.

19. The non-transitory computer readable medium of claim 18, wherein the registration prompt displays to the new player the unique verification information.

* * * * *